US005188320A

United States Patent [19]

Polka

[11] Patent Number: 5,188,320

[45] Date of Patent: Feb. 23, 1993

[54] NURSING BOTTLE HOLDER

[76] Inventor: John G. Polka, 1355 Margate, Libertyville, Ill. 60048

[21] Appl. No.: 695,989

[22] Filed: May 6, 1991

[51] Int. Cl.[5] ..... A47D 15/00

[52] U.S. Cl. ..... 248/103; 248/102

[58] Field of Search ..... 218/102, 103, 104, 105

[56] References Cited

U.S. PATENT DOCUMENTS

| | | | |
|---|---|---|---|
| 1,464,525 | 8/1923 | Girr | 248/102 X |
| 1,859,123 | 5/1932 | Ballert | 240/105 |
| 1,886,619 | 11/1932 | Arnone | 248/105 |
| 2,050,622 | 8/1936 | Menk | 248/105 |
| 2,485,461 | 10/1949 | Siegel | 248/102 |
| 2,526,121 | 10/1950 | Curry et al. | 248/102 |
| 2,631,288 | 3/1953 | Daust | 248/102 X |
| 3,620,491 | 11/1971 | Baclit | 248/104 X |
| 4,405,106 | 9/1983 | Adler | 248/102 |
| 4,726,551 | 2/1988 | Randall et al. | 248/102 |
| 4,895,327 | 1/1990 | Malone et al. | 248/102 |

*Primary Examiner*—J. Franklin Foss

*Attorney, Agent, or Firm*—Edmond T. Patnaude

[57] ABSTRACT

A resilient member having a central section is adapted to fit against the chest of the infant and two generally parallel downwardly extending side sections are adapted to fit snugly under the arms and against the sides of the infant. The central section has an extension which extends over the neck such that when the member is fitted over the chest of an infant, with the sides under the infant's armpits, the extension is in proximity to the chin of the infant. An inclined groove is provided along the upper surface of the extension for frictionally holding a nursing bottle in an inclined angle relative to the mouth of the infant.

6 Claims, 1 Drawing Sheet

NURSING BOTTLE HOLDER

The present invention relates to nursing bottle holders and in particular to nursing bottle holders for nursing an infant child who is reclining on his or her back.

BACKGROUND OF THE INVENTION

Infant children have a liquid diet and are generally fed by means of a nursing bottle having a nipple which is adapted to dispense the liquid when the infant is sucking on the nipple. Infants require frequent feedings which involves the holding of a nursing bottle in an inclined position where the infant can easily reach the nipple with its mouth. After being fed, infants often fall asleep and most parents prefer that the infant sleep undisturbed for as long as possible. Very young infants are unable to roll over and have a limited ability to interfere with the feeding process, and therefore very young infants can be fed from an inclined bottle cradled in a towel or other pliable material on or near the chest of a reclining infant. However, a slight movement of the infant, or the changing distribution of the weight of the nursing bottle as the liquid is withdrawn will frequently disrupt such supporting structures causing the nipple to be withdrawn from the infant's mouth or changing the incline of the bottle such that the infant can no longer withdraw the liquid through the nipple.

Some of the prior art devices for feeding a reclining infant provide for retaining a nursing bottle in an inclined position such as those described in U.S. Pat. Nos. 2,134,746 and 2,050,622. These devices can be easily removed after a child has fallen asleep but they fail to provide a means for holding the nipple in the general proximity of the infant's mouth. Existing devices which do hold a bottle in proximity to the infant's mouth, such as those shown in U.S. Pat. Nos. 2,526,121 and 4,726,551, require that the device be strapped around the body of the infant. Such devices cannot be easily removed without the risk of awakening a sleeping infant.

It would be desirable to provide a nursing bottle holder which would hold a nursing bottle in an inclined position over the chest of an infant and which could be readily removed after feeding is complete without disturbing the infant.

BRIEF DESCRIPTION OF THE INVENTION

Briefly there is provided in accordance with the present invention a resilient member having a central section adapted to fit against the chest of the infant and two generally parallel downwardly extending side sections adopted to fit snugly under the arms and against the sides of the infant. In the preferred embodiment, the central section has an extension which extends over the neck such that when the member is fitted over the chest of an infant, with the sides under the infant's armpits, the extension is in proximity to the chin of the infant. An inclined groove is provided along the upper surface of the extension for frictionally holding a nursing bottle in an inclined angle relative to the mouth of the infant.

BRIEF DESCRIPTION OF THE DRAWINGS

The present invention will be better understood from a reading of the following detailed description in connection with the accompanying drawings wherein.

DETAILED DESCRIPTION OF A PREFERRED EMBODIMENT OF THE INVENTION

Figure 2:
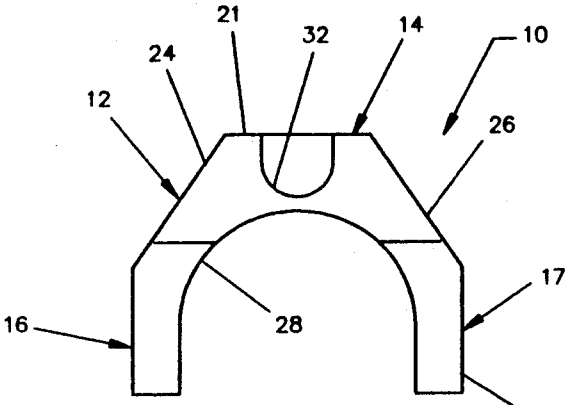
FIG. 2 is an elevational view of the nursing bottle shown in FIG. 1 as seen from the front thereof.

Referring to FIGS. 1–4, a unitary nursing bottle holder 10 embodying the present invention is formed of a resilient material such as a opened cell polyurathane foam tested and approved for use on children's toys having a 45 lb indentation load deflection and 16 lb/cu ft density. As seen in FIG. 2, the bottle holder 10 includes a body section 12 having a generally semicircular cross section comprising a central section 14 and two generally parallel depending side sections 16 and 17.

Figure 3:
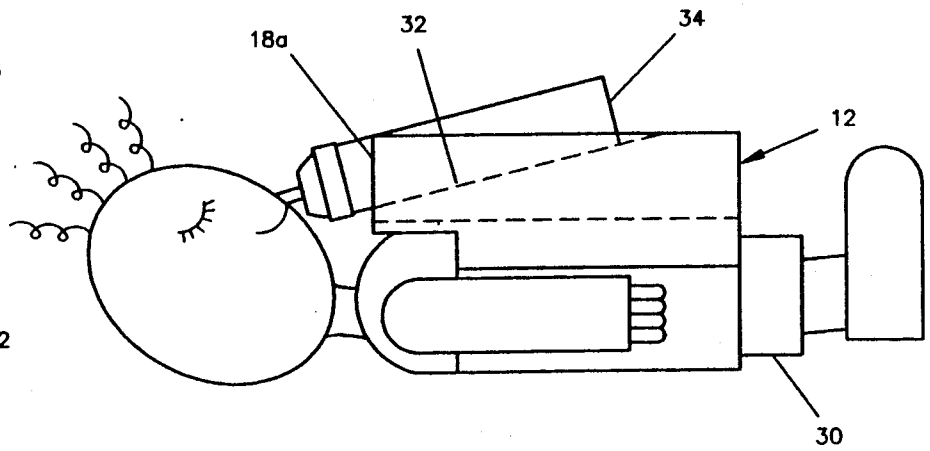
FIG. 3 is a side view of the nursing bottle holder shown in FIG. 1 showing the bottle holder fitted over an infant.
Figure 4:
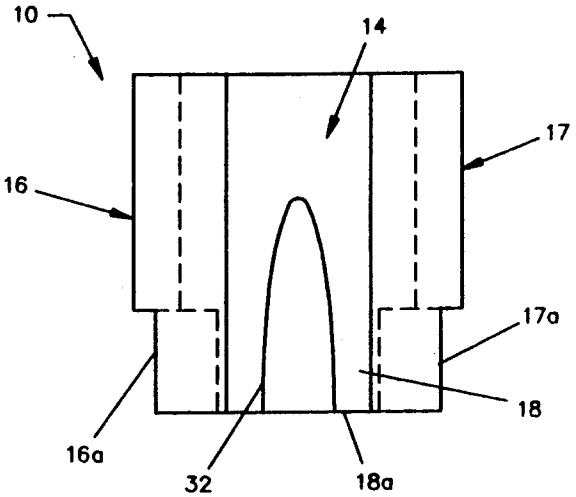
FIG. 4 is a top view of the nursing bottle holder shown in FIG. 1.
Figure 1:
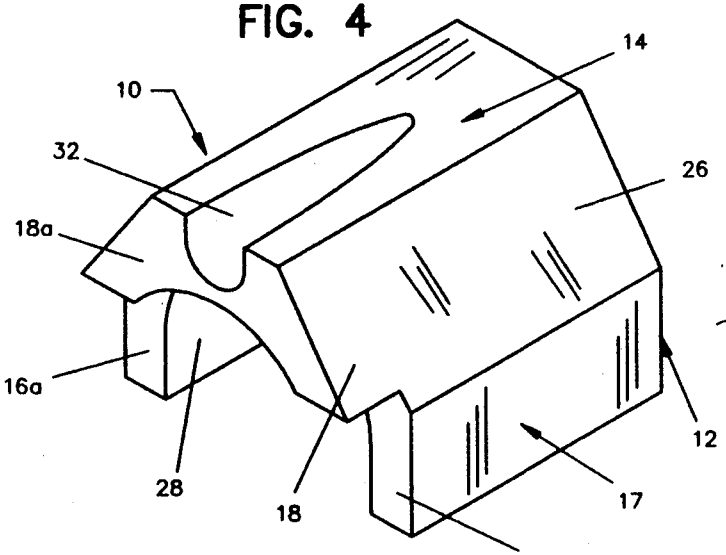
FIG. 1 is an isometric view of a nursing bottle holder constructed in accordance with the present invention.

As can be seen in FIG. 3, the central section 14 has an extension 18 which extends longitudinally beyond the ends 16*a* and 17*a* of the side sections 16, 17 respectively. In the preferred embodiment, the outer surfaces 19, 20 of the side sections 16, 17, respectively, are planar and parallel to each other and the upper surface 21 of the central section 14 and the extension 18 is also planar and perpendicular to the outer surfaces 19, 20 of the side sections 16, 17. The outer surfaces 19, 20 of the side sections 16, 17 are spaced from the upper surface 21 by angular surfaces 24, 26 respectively. As best seen in FIGS. 1 and 2, and 3 the inner surface 28 of the body 12 has a generally arcuate cross section and is adapted to fit snugly around the chest of an infant with the side sections 16, 17 compressed against the sides of the infant 30 to hold the bottle holder 10 in place.

An inclined groove 32 in the upper section 14 and the extension 18 is parallel to the longitudinal axis of the body 12 and has its greatest depth at the distal end 18*a* of the extension 18 and gradually become shallower and ends near the bottom end 33 of the central section 14. As can be seen in FIG. 3, the groove 32 has a width smaller than the width of a nursing bottle and is adapted to frictionally retain a nursing bottle 34.

When fitted over the chest of an infant 30, the infants shoulders will project around the ends 16*a*, 17*a* of the side sections 16, 17 and below the extension 18, and the infant's arms will extend along the side sections 16, 17. The extension 18 of the central section 14 is adapted to approach the chin of an infant 30 such that when a nursing bottle 34 is wedged into the groove 32, the nipple will be positioned near the mouth of the infant 30. A nursing bottle holder is thereby provided which will hold a nursing bottle in the proximity of the infant's mouth while the infant rests on its back without requiring the device to be strapped to the infant, such that it can be easily removed without awakening a sleeping infant.

The nursing bottle holder 10 can be made inexpensively as a single piece item using either a mold or a die cutting process. The distance between the inner surfaces of the side sections 16 and 17 is such that the sides 16 and 17 will be bent outwardly when the nursing bottle holder is fitted over an infant. The resilient material of the sides 16 and 17 will thereby grip the sides of an infant and retain the nursing bottle in the desired position even though the infant moves during the feeding process. The resilience of the material permits the nursing bottle holder 10 to be used with large or small infants, or by the same infant as he or she grows older. The one piece item will not disassemble and leave small parts which may enter an infant's mouth and the polyurathane approved for children is non toxic. Furthermore, the bottle holder 10 can be easily cleaned by placing it in a conventional cloth washing machine to remove residue, juices or milk.

Although the invention has been described as having been made from an open cell polyurathane, it should be noted that if the invention is made with a die cutting process the cells will be open to the ambient whereas if it is made from a mold, a skin will be formed on the outer surface of the invention which will seal the cells and the invention will have the same qualities as though it were made of a closed cell material. When an open cell material is cut with a die, the open cells will absorb excess milk or other liquid which may leak from the nursing bottle. Somewhat different qualities will result when the cells are sealed. Specifically the material will not absorb liquids, and the invention can therefore by easily washed between uses.

While the present invention has been described in connection with a particular embodiment, it will be understood by those skilled in the art that many changes and modifications may be made without departing from the true spirit and scope of the invention. Therefore, it is intended by the appended claims to cover all such changes and modifications which come within the true spirit and scope of the invention.

What is claimed is:

1. A nursing bottle holder for holding a nursing bottle having a nipple at one end comprising in combination, a body member formed of a unitary piece of resilient material having a central section and two opposing side sections, said side sections having distal ends, and said side sections being positioned relative to said central section such that said distal ends of said side sections snugly fit against the sides of a reclining infant when said central section is positioned against the chest of said reclining infant, and said central section has a longitudinal extension which extends beyond said side sections and between the shoulders of said reclining infant when said distal ends of said side sections are fitted against the sides of said reclining infant, and said central section having an inclined groove therein for frictionally retaining a nursing bottle such that said bottle will be inclined with said nipple angled downwardly and be positioned near said infant's mouth when said distal ends of said side sections are positioned against said sides of said infant.

2. A nursing bottle holder in accordance with claim 1 wherein said two opposing side sections may be bent outwardly.

3. A nursing bottle holder in accordance with claim 1 wherein said groove has deep and shallow portions, said deep portion being in said extension and said shallow portion in said central section.

4. A nursing bottle holder in accordance with claim 3 wherein said upper section and said opposing side sections having a generally arcuate inner cross section for receiving the upper torso of an infant.

5. A nursing bottle holder in accordance with claim 1 wherein said inclined groove extends into said longitudinal extension.

6. A nursing bottle holder in accordance with claim 5 wherein said longitudinal extension has a distal end, and said inclined groove is deepest at said distal end and shallower near said central section.

* * * * *